US008866863B2

(12) United States Patent
Ishii et al.

(10) Patent No.: US 8,866,863 B2
(45) Date of Patent: Oct. 21, 2014

(54) PORTABLE THERMAL PRINTER

(71) Applicant: Toshiba TEC Kabushiki Kaisha, Tokyo (JP)

(72) Inventors: Hiroyasu Ishii, Shizuoka (JP); Motohito Tsuchiya, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/184,805

(22) Filed: Feb. 20, 2014

(65) Prior Publication Data

US 2014/0168342 A1 Jun. 19, 2014

Related U.S. Application Data

(63) Continuation of application No. 13/450,615, filed on Apr. 19, 2012, now Pat. No. 8,692,858.

(51) Int. Cl.
*B41J 11/00* (2006.01)
*B41J 15/04* (2006.01)

(52) U.S. Cl.
CPC ..... *B41J 15/046* (2013.01)
USPC ..... 347/218

(58) Field of Classification Search
USPC ..... 347/171, 187, 193, 213, 215, 217, 218, 347/101, 105
See application file for complete search history.

(56) References Cited

U.S. PATENT DOCUMENTS

| | | | | |
|---|---|---|---|---|
| 5,618,117 | A * | 4/1997 | Yoshida et al. | 347/218 |
| 7,027,076 | B2 * | 4/2006 | Ruiz et al. | 347/193 |
| 7,671,879 | B2 * | 3/2010 | Tatewaki et al. | 347/218 |

FOREIGN PATENT DOCUMENTS

| | | |
|---|---|---|
| JP | 03-293178 | 12/1991 |
| JP | 04-071874 | 3/1992 |
| JP | 2008-087861 | 4/2008 |
| JP | 2009-173353 | 8/2009 |

* cited by examiner

*Primary Examiner* — Kristal Feggins
(74) *Attorney, Agent, or Firm* — Amin, Turocy & Watson, LLP

(57) ABSTRACT

A portable thermal printer includes a housing and an anti-skew unit. The housing is provided with a thermal printer head and a platen roller, and is configured to convey a paper between the thermal printer head and the platen roller. The anti-skew unit inside the housing is configured to contact both side edges of the paper in a width direction to prevent the paper, which is being conveyed, from skewing, and the setting of the width of the paper by the anti-skew unit is configured to be adjustable from outside the housing.

10 Claims, 9 Drawing Sheets

PORTABLE THERMAL PRINTER

CROSS-REFERENCE TO RELATED APPLICATIONS

This application is a Continuation of application Ser. No. 13/450,615 filed on Apr. 19, 2012, the entire contents of which are incorporated herein by reference.

FIELD

Embodiments described herein relate to a portable thermal printer.

BACKGROUND

Conventionally, there has been used a thermal printer that has a thermal printer head including a row of heat-generating elements in a width direction. In such a thermal printer, paper, specifically thermal paper, passes between the thermal printer head and a platen roller. The platen roller rotates and is configured to be urged against the thermal printer head. In this configuration, the thermal printer head performs printing on the paper by applying a predetermined pressure to the paper.

Recently, a portable thermal printer has been developed. The portable thermal printer exhibits excellent mobility, since it can be carried anywhere by a user and be operated at a commercial place, especially where such mobility is required to input sales information such as a discounted price or a time-limited service for the sale of products.

DETAILED DESCRIPTION

According to one embodiment of the present disclosure, a portable thermal printer includes a housing provided with a thermal printer head and a platen roller. The housing in configured to convey a paper between the thermal printer head and the platen roller. The portable thermal printer further includes an anti-skew unit disposed inside the housing. The anti-skew unit is configured to contact both side edges of the paper in a width direction to prevent the paper, which is being conveyed, from skewing. The setting of a width of the paper by the anti-skew unit is configured to be adjustable from outside of the housing.

A portable thermal printer S according to one embodiment will now be described in detail with reference to the drawings.

Figure 1:
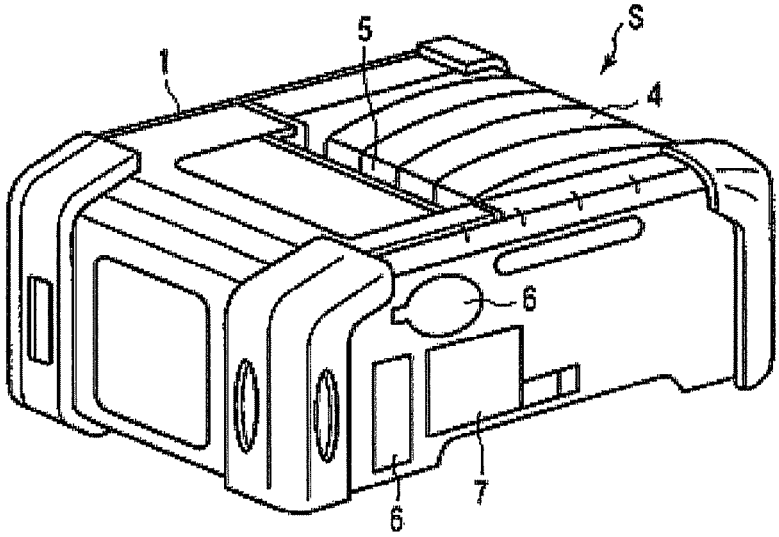
FIG. 1 is a perspective view of the external appearance of a thermal printer.
Figure 2:
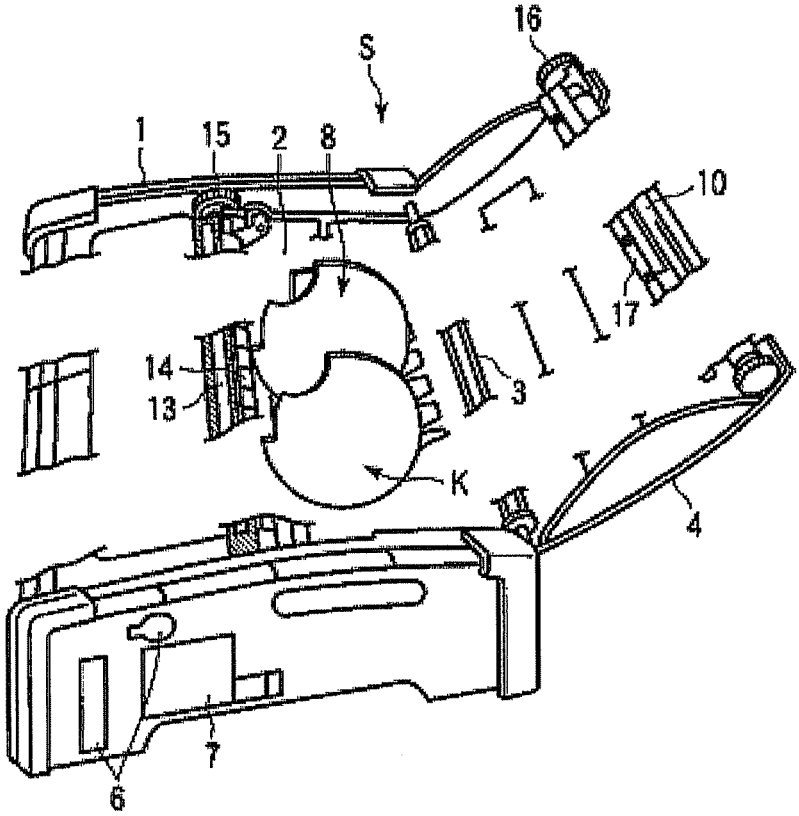
FIG. 2 is a schematic configuration view of the portable thermal printer, in which the cover is open.
Figure 3:
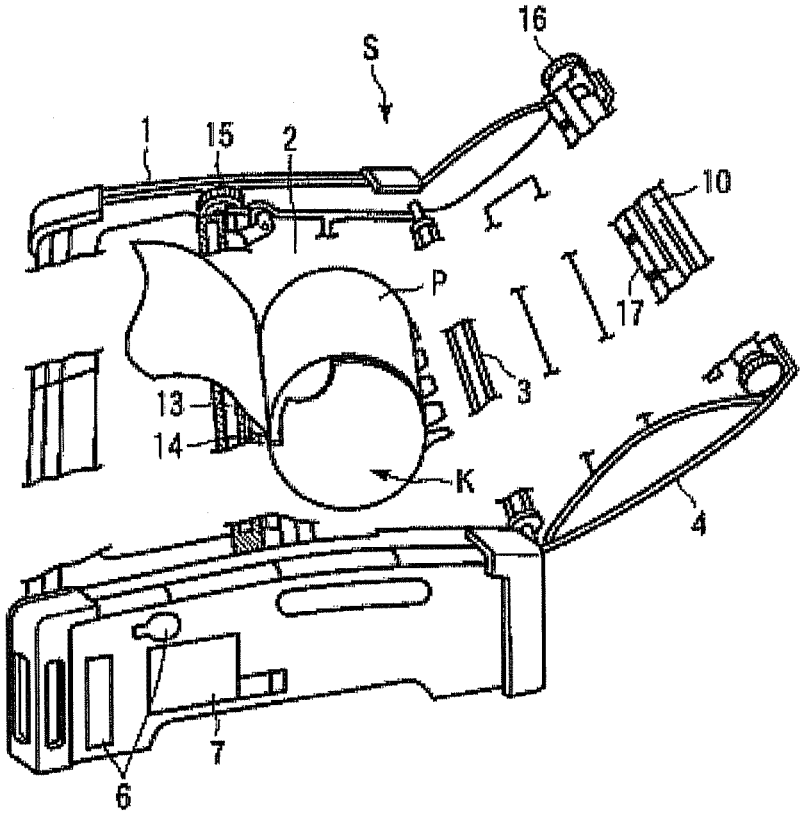
FIG. 3 is a schematic configuration view of the portable thermal printer, in which the cover is open, with a roll paper contained therein.

FIG. 1 is a perspective view of the external appearance of the thermal printer S according to one embodiment. FIG. 2 is a schematic configuration view of the portable thermal printer S, in which a cover 4 is open. FIG. 3 is a schematic configuration view of the portable thermal printer S, in which the cover 4 is open, with a roll paper P contained therein. As shown in FIGS. 2 and 3, the printer S is illustrated as being divided into a plurality of sections in the width direction. In other words, if the divided sections of the printer S are combined with each other, such combination will substantially coincide with the actual size of the printer in the width direction.

The portable thermal printer S may be a type of printer that can print on a sheet of paper having a width of, for example, two inches or less. For example, the portable thermal printer S may have a rectangular shape with a width of about 88 mm, a depth of about 119 mm, and a height of about 65 mm. Since the printer S has a compact size and is light-weight, with a weight of about 450 g including a battery, it can be carried anywhere by a user to perform a printing operation.

All of the components of the printer S are contained inside a housing 1, and a thermal paper being wound in the form of a roll (hereinafter, referred to as "roll paper") P is also contained inside the housing 1. The housing 1 has an opening 2 in the upper surface thereof, through which the roll paper P can be fed into the housing 1. The opening 2 can be opened and closed by the cover 4, which is disposed on the housing 1 via a pivot support shaft 3.

The pivot support shaft 3 is disposed along the inner side of the housing 1, which forms one side of the opening 2. In a state in which the cover 4 is closed, a narrow and long space 5 is formed along the width direction of the housing 1 between the front outer edge of the cover 4 and one side of the housing 1 which corresponds to one side of the opening 2.

Through the space 5, the roll paper P on which printing is performed is discharged. Therefore, the space 5 functions as a paper discharge outlet 5. The front side of the housing 1 and the outer edge of the cover 4, which define the paper discharge outlet 5, may have a sharp shape so that the printed roll paper P discharged from the paper discharge outlet 5 can be easily cut.

In addition, a connector part 6 and a battery container 7 are disposed on the right side of the housing 1.

A paper container 8, which can removably contain the roll paper P therein, is formed inside the housing 1. The roll paper P is contained in the paper container 8 in a state in which the roll shaft is placed along the width direction of the housing 1. The roll paper P is drawn out by a platen roller 10, which constitutes a conveying unit as described below, and is conveyed toward the paper discharge outlet 5.

When the roll paper P is drawn out by the platen roller 10, an anti-skew mechanism (the anti-skew unit) K prevents skewing, i.e., movement of the paper dislodging in the width direction. The anti-skew mechanism K will be described in detail with reference to FIG. 4 to FIG. 9.

A thermal printer head 13, which constitutes a printing unit, is installed inside the housing 1. The thermal printer head 13 has a row of heat-generating elements, which are installed in the width direction of the paper P. As the row of heat-generating elements generates heat under the control of a control unit, the thermal printer head 13 performs printing on the paper P.

A head bracket is installed adjacent to the thermal printer head 13, such that the head bracket is biased inward and upward to the front side of the thermal printer head 13. A head cover 14 is installed adjacent to the inner portion of the thermal printer head 13. The head cover 14 may be mounted on the housing 1 as required, and is configured to press and bias the thermal printer head 13 in order to prevent it from vibrating.

A drive motor is disposed on one edge of the thermal printer head 13 inside the housing 1, and a drive gear 15 is mounted in the drive motor. The platen roller 10 is rotatably supported along the outer edge of the cover 4 with a driven gear 16 connected to one end thereof The driven gear 16 is configured to engage with the drive gear 15 when the cover 4 is closed.

A paper pressing roller 17 is disposed parallel to the platen roller 10. The platen roller 10 and the paper pressing roller 17 are positioned on the cover 4. By closing the cover 4, the platen roller 10 comes into contact with the row of heat-generating elements of the thermal printer head 13, and the paper pressing roller 17 comes into contact with the head cover 14.

In the portable thermal printer S having the above-described configuration, the roll paper P is contained in the paper container 8, a leading edge of the roll paper P is pulled and drawn out, and then the cover 4 is closed. The drawn roll paper P is disposed between the thermal printer head 13 and the platen roller 10, as well as between the head cover 14 and the paper pressing roller 17.

In a state in which the cover 4 is closed, the thermal printer head 13, the platen roller 10, the head cover 14 and the paper pressing roller 17 define a guide path that guides the roll paper P to the paper discharge outlet 5. Furthermore, if the cover 4 is closed, the drive gear 15 is engaged with the driven gear 16, and a drive signal is output from a control unit to the drive motor so that the drive gear 15 is driven to rotate.

As the rotary driving force of the drive gear 15 is transmitted to the platen roller 10 through the driven gear 16, the roll paper P is conveyed by the platen roller 10 and is guided along the guide path, with the anti-skew mechanism K preventing it from skewing.

That is, the roll paper P passes between the thermal printer head 13 and the platen roller 10 toward the paper discharge outlet 5. Under the control of the control unit, the row of heat-generating elements of the thermal printer head 13 generates heat and thus prints predetermined contents on the roll paper P.

The anti-skew mechanism K will now be described in detail.

Figure 4:
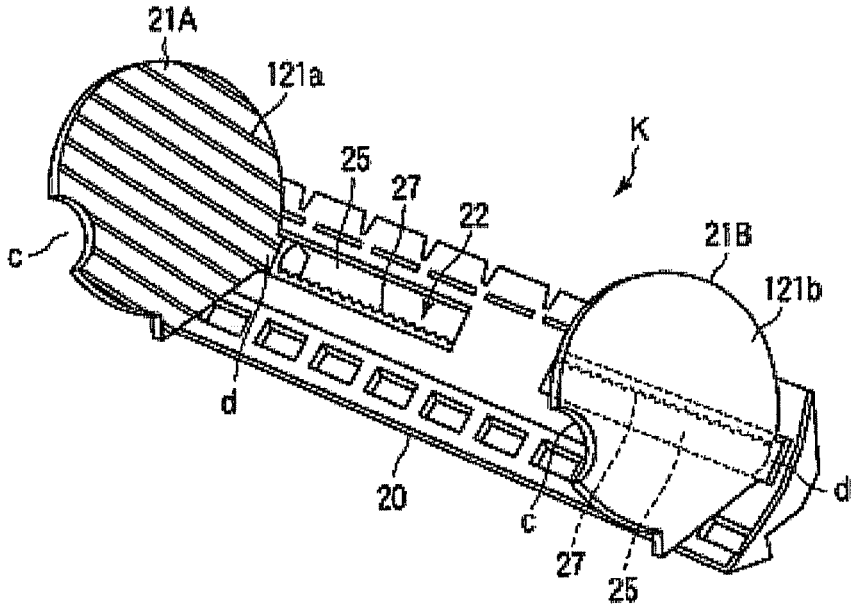
FIG. 4 is a schematic perspective view of an anti-skew mechanism.
Figure 5:
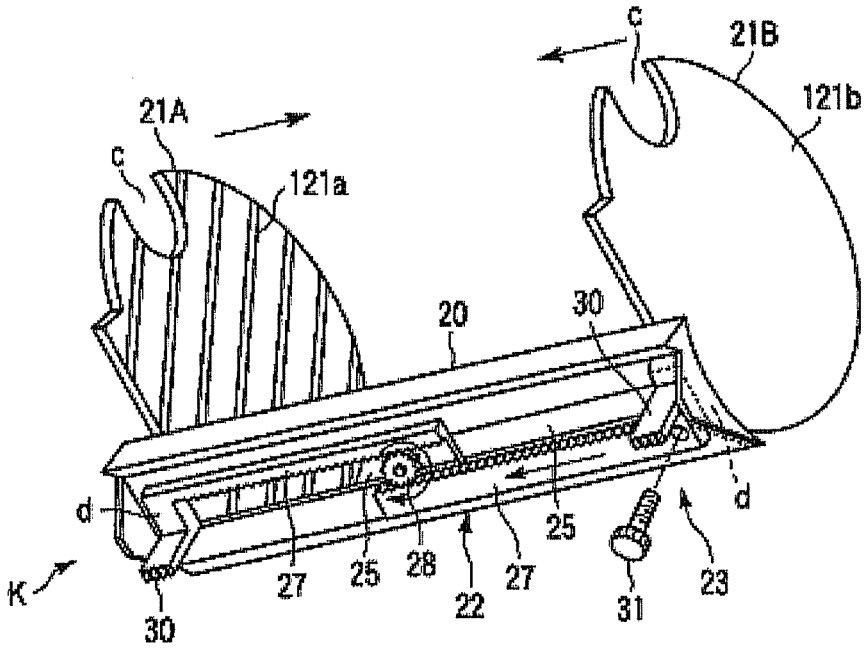
FIG. 5 is a schematic perspective view of the rear side of the anti-skew mechanism.

FIG. 4 is a schematic perspective view of the anti-skew mechanism K, which is taken outside of the housing 1, and FIG. 5 is a schematic perspective view of the anti-skew mechanism K viewed from the rear side, which corresponds to the bottom part of the housing 1.

As described above, the anti-skew mechanism K has the function of preventing skewing, i.e. movement of the paper dislodging in the width direction perpendicular to the direction in which the roll paper P is conveyed, while conveying the roll paper P. The anti-skew mechanism K is disposed in the paper container 8, but partially protrudes from the inside to the outside of the housing 1.

The anti-skew mechanism K includes two opposite guide fences 21A and 21B as base components, such that the guide fences can slide on a rail member 20. Each of the guide fences 21A and 21B is configured to apply a pressure against respective side edges of the roll paper P, which is contained in the paper container 8, thereby controlling skewing of the paper P while it is being conveyed.

Specifically, the anti-skew mechanism K includes the rail member 20, the guide fences 21A and 21B, a rack-and-pinion gear mechanism 22 and a slide adjustment member 23.

The rail member 20 is a thin plate member that is installed along the entire length of the housing 1 in the width direction so that it connects both side walls of the housing 1, and its cross section is curved substantially into a circular arc shape. Rail slots 25 are provided at two positions that are symmetric to both side edges of the rail member 20, along the longitudinal direction of the rail member 20. Although the rail member 20 is located inside the housing 1 in this embodiment, the rail member 20 may be disposed at the bottom 1*a* of the housing 1 such that the rail slots 25 are exposed to the outside.

Specifically, an outer end of each rail slot 25 is disposed at a position adjacent to one side edge of the rail member 20, and an inner end of each rail slot 25 is disposed at a position spaced apart by a predetermined distance from an approximately central position of the rail member 20 in the width direction. Therefore, a portion of the rail member 20 is disposed between the respective inner ends of the two rail slots 25.

On the upper surface of the rail member 20, the guide fences 21A and 21B are installed in corresponding rail slots 25 such that the guide fences 21A and 21B can slide along the longitudinal direction of the rail slots 25. Since each rail slot 25 is disposed such that the outer end thereof is adjacent to the corresponding side edge of the rail member 20, the respective guide fences 21A and 21B can be located adjacent to both side walls of the housing 1, which correspond to both side edges of the rail member 20.

As described above, the inner ends of the rail slots 25 are disposed to have a predetermined distance from each other in the central portion of the rail member 20 in the longitudinal direction thereof. Consequently, the guide fences 21A and 21B can be displaced to positions adjacent to each other. That is, the guide fences 21A and 21B may be configured to grab various sizes of roll paper P, which is used as a recording medium in the printer S.

Each guide fence 21A and 21B is formed using flat parts 121*a*, 121*b* having a substantially disc-like shape as a main body. In addition, as described later, each guide fence 21A and 21B has a notch c in a side portion thereof such that the guide fence does not interfere with the thermal printer head 13 or the head cover 14 during sliding movement of the guide fence.

The surfaces of the flat parts 121*a* and 121*b* on the guide fences 21A and 21B, which oppose each other, function as contact surfaces that may come into contact with both side sections of the roll paper P. Further, when the roll paper P is drawn out, the surfaces of the flat parts 121*a* and 121*b* come into contact with side edges of a sheet of the roll paper P. Moreover, a plurality of parallel grooves is formed in the surfaces of the flat parts 121*a* and 121*b*. In addition, each of the flat parts 121*a* and 121*b* has a protrusion d integrally formed in the lower end thereof, the protrusion d being movably fitted into a corresponding rail slot 25.

Rack gears 27 are integrally connected to the bottom of the protrusion d of each guide fence 21A and 21B. The rack gears 27 are arranged to extend along the bottom of the rail member 20, and when respective guide fences 21A and 21B are slid, the rack gears 27 also slide in conjunction with the sliding movement of the guide fences 21A and 21B along the rail member 20.

As shown in FIGS. 4 and 5, when the guide fences 21A and 21B are in the positions of both side ends of the rail slots 25, a front end part of one rack gear 27 is placed in parallel and overlap with a front end part of the other rack gear 27 with a predetermined space from each other. In this state, the front end parts of the two rack gears 27 are engaged with each other via a pinion gear 28, which is rotatably disposed on the central portion of the bottom of the rail member 20. Even though in this configuration, one pinion gear 28 is engaged with the two rack gears 27, two or more pinion gears may be separately arranged to be engaged with the rack gears 27.

When one of the guide fences 21A and 21B is pressed to slide toward the central portion of the rail member 20 (from the position shown in FIGS. 4 and 5), one of the rack gears 27, which is integrated with a respective guide fence 21A and 21B, also slides. Then, the other rack gear 27 and the other guide fence slide toward the central portion via the pinion gear 28, so that the guide fences 21A and 21B approach each other.

From the position to which the guide fences 21A and 21B have approached each other, when one of the guide fences 21A and 21B is pressed to slide toward the outer end of the rail member 20, the rack gear 27 that is integrated with the guide fence also slides. Then, the other rack gear 27 and the other guide fence slide toward the other outer end of the rail member 20 via the pinion gear 28, so that the guide fences 21A and 21B move away from each other.

In this fashion, the rack gears 27 and the pinion gear 28 constitute the rack-and-pinion gear mechanism 22, which is configured to make one of the guide fences 21A and 21B slide in conjunction with the sliding movement of the other guide fence such that the two guide fences 21A and 21B can approach to each other.

As shown in FIG. 5, an adjustment knob 30 is installed on the rear surface of each rack gear 27. The adjustment knob 30 is a protrusion having the form of a flat plate, with a front surface thereof having a plurality of repeated concave-convex patterns thereon. The adjustment knob 30 is disposed on a side end of the rack gear 27, which is aligned with the position of the corresponding guide fence 21A and 21B. The guide fences 21A and 21B are disposed at positions that are symmetrical with the positions of the associated adjustment knobs 30, with the rack gears 27 disposed therebetween.

In addition, a fixing screw 31 is disposed in a portion of one of the rack gears 27 (as illustrated on the right side of FIG. 5), adjacent to the adjustment knob 30 that protrudes from the rack gear 27. The adjustment knob 30 and the fixing screw 31 form the above-described slide adjustment member 23. However, the position and number of the fixing screw 31 is not limited to this configuration, but may be changed in some other embodiments. Further, the slide adjustment member 23 protrudes out of the bottom 1*a* of the housing 1, regardless of the location of the rail member 20.

In the following, the structure for installing the fixing screw 31 with respect to the rack gear 27 and the structure for installing the slide adjustment member 23 with respect to the housing 1 are described in detail.

Figure 6:
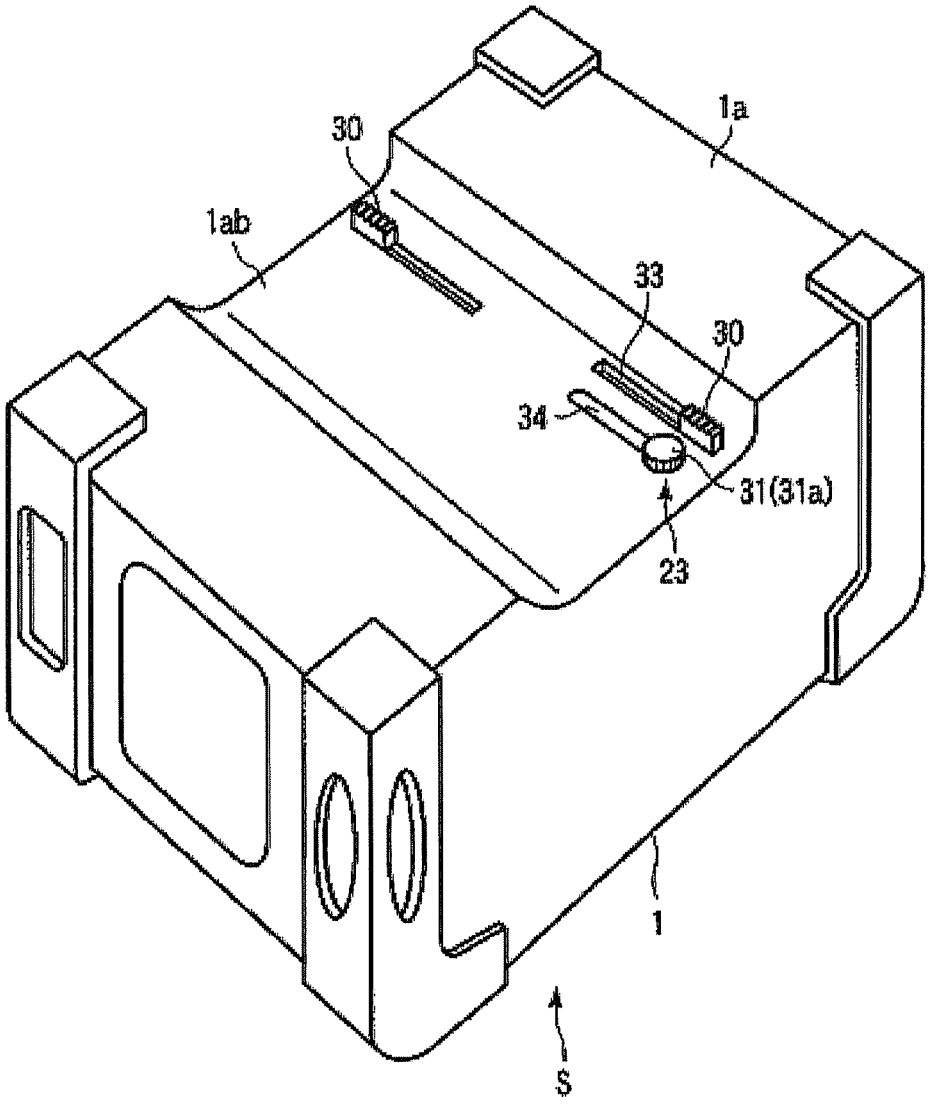
FIG. 6 is a perspective view of the bottom of the portable thermal printer.
Figure 7:
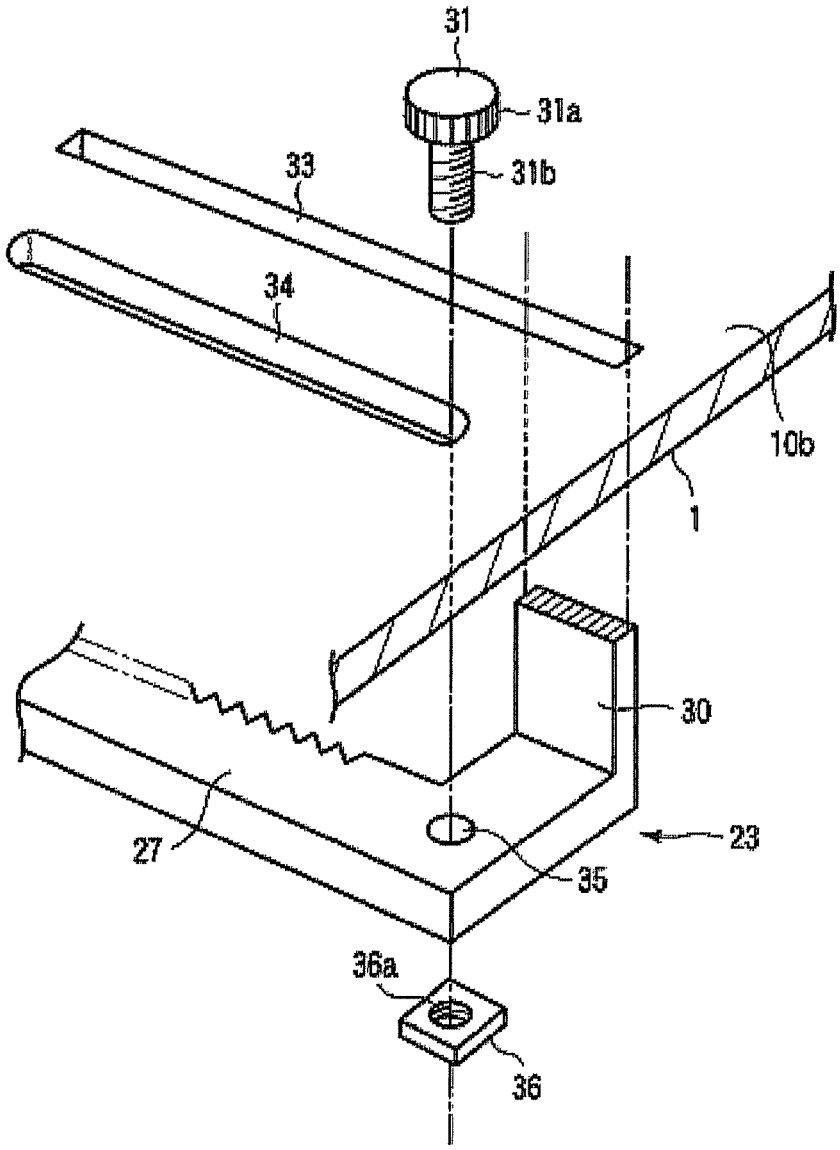
FIG. 7 is an exploded perspective view of the key parts of the anti-skew mechanism.
Figure 8:
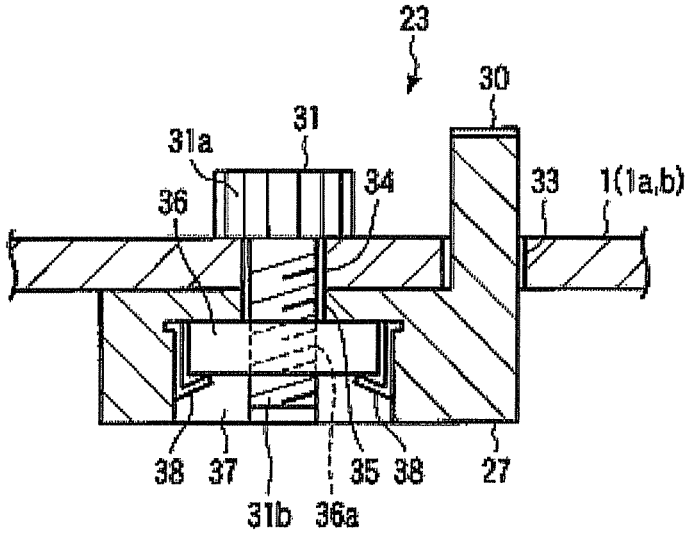
FIG. 8 is a longitudinal cross-sectional view of the key parts of the anti-skew mechanism.
Figure 9:
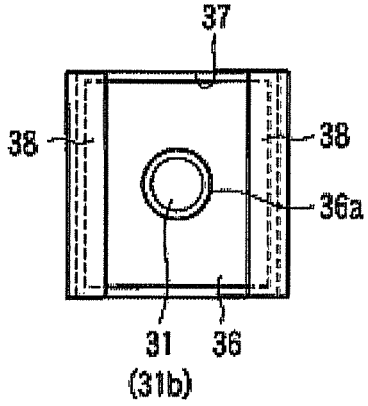
FIG. 9 is a rear view of the key parts of the anti-skew mechanism.

FIG. 6 is a perspective view of the bottom structure of the printer S according to one embodiment. FIG. 7 is a perspective view showing the structure by which the slide adjustment member 23 is installed with respect to the housing 1. FIG. 8 is a cross-sectional view showing the structure by which the fixing screw 31 is installed with respect to the housing 1 and the rack gear 27. FIG. 9 is a partial plan view of FIG. 8.

FIGS. 6 to 9 show one example of the printer S shown in FIG. 1 in an upside-down state. In these drawings, the guide fences 21A and 21B are not depicted for sake of simplicity.

The adjustment knobs 30 arranged on opposite sides of the bottom structure constitute the slide adjustment member 23, which is integrally installed with the opposite rack gears 27 described above. The adjustment knobs 30 are inserted into long holes 33 for guiding the adjustment knob 30, which are installed in the bottom 1*a* of the housing 1, and protrude from the bottom 1*a*. The long holes 33 are formed to extend over a length that corresponds to the range in which the adjustment knobs 30 can move.

The fixing screw 31, which is installed in one rack gear 27, is inserted into an elongated slot 34 for guiding the fixing screw 31 installed in the bottom 1*a* of the housing 1, and the head 31*a* of the screw 31 protrudes from the bottom 1*a*. The elongated slot 34 is formed over a length that corresponds to the range in which the fixing screw 31 can move.

The bottom 1*a* of the housing 1 is formed to have the same height along a predetermined length extending from one end side of the printer S to the other end side thereof, with only its central portion being recessed to form a bottom concave section 1*ab*. The long holes 33 and the elongated slot 34 are disposed in the bottom concave section 1*ab*. The protrusion amount by which the adjustment knobs 30 protrude from the long holes 33 and the protrusion amount by which the fixing screw 31 protrudes from the slot 34 are smaller than the depth of the recess of the bottom concave section 1*ab*.

That is, when the printer S is oriented in a regular position by turning it upside down from the state shown in FIG. 6 to the position shown in FIG. 1, each front end of the adjustment knobs 30 and the head 31*a* of the fixing screw 31 do not contact a surface (e.g., a top surface of a table) on which the printer S is placed. Consequently, the posture of the printer S is stable.

A screw section 31*b* of the fixing screw 31 passes through the elongated slot 34 of the housing 1 and a through-hole 35, which is formed in the rack gear 27, and is then screwed into a plate nut 36 which is installed in the rack gear 27. The structure by which the plate nut 35 is installed to the rack gear 27 is as follows.

As shown in FIGS. 8 and 9, a rectangular recess 37 is formed to a predetermined depth from one surface of the rack gear 27 (i.e. the surface on which the guide fence is disposed), which is opposite the surface from which the adjustment knob 30 protrudes. Fixing hooks 38 are attached on opposite sides of the recess 37.

The plate nut 36 is formed with an area and a plate thickness that allow the plate nut 36 to be inserted into the recess 37, with both side edges of the plate nut 36 being fixedly supported by the fixing hooks 38. In this state, a screw hole 36*a* of the plate nut 36 extends to the elongated slot 34 of the housing 1 via the through-hole 35 of the rack gear 27.

Here, the screw section 31*b* of the fixing screw 31 is inserted into the through-hole 35 of the rack gear 27 from the elongated slot 34 of the housing 1, and is screwed into the screw hole 36*a* of the plate nut 36. The front end of the screw section 31*b* protrudes from the plate nut 36 into the recess 37 of the rack gear 27.

If the fixing screw 31 is tightened, the housing 1 and the rack gear 27 are strongly held and fixed together between the fixing screw head 31*a* and the plate nut 36. Since the position of the rack gear 27 to the housing 1 is fixed, even if one of the adjustment knobs 30 is pressed to slide, neither the rack gears 27 nor the side fences 21A and 21B will move.

If the fixing screw 31 is released, the rack gear 27 is unfastened from the housing 1 allowing for the performance of a pressing operation on the adjustment knob 30.

The anti-skew mechanism K is configured as above, and the operation described below is performed when the roll paper P is actually contained in the housing 1.

First, the cover 4 is opened by placing the printer S in the regular state, in which the upper part is positioned right side up, as shown in FIG. 1. If upon checking the paper container 8, the roll paper P is found to be contained in the paper container 8, as shown in FIG. 3, the front edge of the roll paper P is drawn out and loaded on the thermal printer head 13. Then, the cover 4 is closed, and the front edge of the roll paper P protruding out of the paper discharge outlet 5 is checked.

In some cases, it is difficult to contain the roll paper P in the paper container 8. In other words, there is a state in which the current distance between the guide fences 21A and 21B of the anti-skew mechanism K is narrower than the width of the roll paper P.

With this configuration, an operator may place a finger on the bottom 1*a* (more specifically, the bottom concave section 1*ab*) of the housing 1 to find one of the adjustment knobs 30. Alternatively, the housing 1 may be turned upside down, and then the operator may place a finger on one of the adjustment knobs 30, while seeing the adjustment knob 30.

If the adjustment knob 30 is pressed to move toward the side of the housing 1, and the position of the adjustment knob 30 is not changed, it means that the fixing screw 31 is fastened. Therefore, the pressing operation should be performed after the fixing screw 31 is unfastened. If one adjustment knob 30, manipulated by the operator, is pressed to slide toward the side of the housing 1, the other adjustment knob 30 slides toward the opposite side of the housing 1 via the rack-and-pinion gear mechanism 22.

If the cover 4 is opened and the inside of the housing 1 is visible, it is possible to perceive that the side fences 21A and 21B slide away from each other in response to the sliding of the adjustment knobs 30. If an adjustment knob 30 is pressed to slide to the side of the housing 30, the distance between the side fences 21A and 21B is sufficiently widened.

Accordingly, if the roll paper P is applied to the printer S, the roll paper P can be contained in the printer S irrespective of its width.

Afterwards, the operator may place a finger on one of the adjustment knobs 30, and press the adjustment knob 30 to slide toward the central portion of the housing 1, which is in the reverse direction to that described above. The other adjustment knob 30 slides toward the central portion of the housing via the rack-and-pinion gear mechanism 22.

If this operation is performed in a state in which the cover 4 is opened, it can be perceived that the side fences 21A and 21B slide toward each other, and finally contact the side edges of the roll paper P.

The foregoing operation may also be performed in the state in which the cover 4 is closed. In other words, since the position at which the sliding of the adjustment knobs 30 is stopped becomes the position at which the side fences 21A and 21B contact the side edges of the roll paper P, it is not necessary to verify the position by looking at the side fences 21A and 21B.

In any case, when the sliding of the adjustment knobs 30 is stopped, the fixing screw 31 may be tightened, and then the printing operation may be performed.

As above, even if the roll paper P has various types of width dimensions, the roll paper P can be reliably contained in the paper container 8. Thus, the operation of the anti-skew mechanism K can be ensured. Since all operations are performed from outside the housing 1 without requiring the insertion of a finger into the housing 1 after the roll paper P is contained in the housing 1, operability is excellent.

Since the housing 1 can be miniaturized to the greater degree possible, its size becomes advantageous for carrying. In addition, since the slide adjustment members 23 protrudes from the bottom concave section lab of the housing 1, the outer appearance of the printer S is not damaged. Although the fixing screw 31 is installed in one rack gear 27, it may be installed in the other rack gear 27 as well in order to make fixing more reliable.

While certain embodiments have been described, these embodiments have been presented by way of example only, and are not intended to limit the scope of the inventions. Indeed, the novel apparatus and method described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A portable thermal printer comprising:

a housing configured to contain a paper being wound in a form of a roll, the housing having a bottom concave section formed in a bottom of the housing;

a conveying unit configured to convey the paper along a guide path inside the housing;

a printing unit disposed on the guide path, and configured to print on the paper which is being conveyed; and an anti-skew unit configured to prevent the paper which is being conveyed from skewing, and provided with a slide adjustment member to make contact with both side edges of the paper by setting a width of the paper in a direction perpendicular to a direction in which the paper is conveyed, wherein the slide adjustment member of the anti-skew unit is disposed at the bottom of the housing, protrudes out of the housing in the bottom concave section, and is configured to be adjustable from outside of the housing.

2. The printer of claim 1, wherein the anti-skew unit further includes:

a pair of guide fences configured to slide in a width direction of the paper perpendicular to the direction in which the paper is conveyed and contact both side edges of the paper which is being conveyed;

a rail member provided with rail slots, each of guide fences being movably inserted into a corresponding one of the rail slots; and a rack-and-pinion mechanism provided with rack gears disposed along the rail member, each of the guide fences being connected to a corresponding one of the rack gears, and one or more pinion gears disposed on the rail member and engaged with each of the rack gears, wherein the slide adjustment member is integrally disposed on each of the rack gears 2-6 of the rack-and-pinion gear mechanism.

3. The printer of claim 2, wherein the slide adjustment member includes:

a pair of adjustment knobs configured to be integrally disposed on each of the rack gears, and protrude from the housing; and at least one fixing screw disposed in at least one of the rack gears and configured to fix or change a position of the rack gears with respect to the housing, wherein the housing has at least one long hole through which the pair of adjustment knobs are able to slide and an elongated slot through which the at least one fixing screw is engaged.

4. The printer of claim 3, wherein at least one of the rack gears has a recess into which a plate nut is inserted, the at least one fixing screw being screwed into a screw hole of the plate nut through the elongated slot formed in the housing and at least one through-hole formed in the rack gears.

5. The printer of claim 3, wherein each of the adjustment knobs is aligned with a position of a corresponding guide fence.

6. The printer of claim 2, wherein the rail member is disposed at a bottom of the housing.

7. A portable thermal printer comprising:

a housing configured to contain a paper being wound in a form of a roll, the housing having a bottom concave section formed in a bottom of the housing; and an anti-skew unit disposed inside the housing, and configured to contact both side edges of the paper in a width direction to prevent the paper, which is being conveyed, from skewing, the anti-skew unit including a slide adjustment member protruding out of the housing in the bottom concave section and configured to be adjustable from outside the housing.

8. The printer of claim 7, wherein the anti-skew unit further includes:

a pair of guide fences configured to slide in a width direction of the paper perpendicular to the direction in which the paper is conveyed and contact both side edges of the paper which is being conveyed;

a rail member provided with rail slots, each of guide fences being movably inserted into a corresponding one of the rail slots; and a rack-and-pinion mechanism provided with rack gears disposed along the rail member, each of the guide fences being connected to a corresponding one of the rack gears, and one or more pinion gears disposed on the rail member and engaged with each of the rack gears, wherein the slide adjustment member is integrally disposed on each of the rack gears of the rack-and-pinion gear mechanism.

9. The printer of claim 8, wherein the slide adjustment member includes:

a pair of adjustment knobs configured to be integrally disposed on each of the rack gears, and protrude from the housing; and at least one fixing screw disposed in at least one of the rack gears and configured to fix or change a position of the rack gears with respect to the housing, wherein the housing has at least one long hole through which the pair of adjustment knobs are able to slide and an elongated slot through which the at least one fixing screw is engaged.

10. The printer of claim 9, wherein each of the adjustment knobs is aligned with a position of a corresponding guide fence.

* * * * *